United States Patent [19]

Batistelli

[11] 4,317,847

[45] Mar. 2, 1982

[54] PROCESS FOR PRODUCING A SIMULATED WEATHERED ANTIQUE WOOD APPEARING FINISH

[76] Inventor: Nello Batistelli, 11445 Santa Gertrudes, Apt. #27, Whittier, Calif. 90604

[21] Appl. No.: 791,789

[22] Filed: Apr. 28, 1977

[51] Int. Cl.[3] ..... B05D 5/06

[52] U.S. Cl. ..... 427/260; 427/262; 428/151

[58] Field of Search ..... 427/260, 262, 263, 267, 427/268, 368, 429; 428/151, 195, 210, 211

[56] References Cited

U.S. PATENT DOCUMENTS 2,052,350 8/1936 Kelly et al. ..... 427/368 X 3,600,346 8/1971 Spatola ..... 427/368 X

OTHER PUBLICATIONS

Mills, J. F., *Acrylic Painting,* London, Sir Isaac Pitman and Sons Limited, 1965, p. 115, FIG. 20.

*Primary Examiner*—Evan K. Lawrence

*Attorney, Agent, or Firm*—Fred N. Schwend

[57] ABSTRACT

The method of forming a simulated weathered antique wood finish on a surface in which the surface is first coated with a dark paint, and while still wet, a second coat of paint of a lighter color is brushed thereover to streak the same while varying the brushing pressure to vary the amount of blending with the first coat. A third coat of still lighter color is thereafter brushed over the second coat while the latter is still wet to streak the second coat while likewise varying the brushing pressure to vary the amount of blending with the second coat.

4 Claims, No Drawings

PROCESS FOR PRODUCING A SIMULATED WEATHERED ANTIQUE WOOD APPEARING FINISH

BACKGROUND OF THE INVENTION

1. Field of the Invention

This invention relates to a process of forming a weathered antique finish on a surface and has particular reference to a process of forming a finish on a surface to simulate a weathered antique wooden structure.

2. Description of the Prior Art

Various methods have been used heretofore to form an imitation wood coating to be applied to the surfaces of materials of different kinds by applying a tint coat of paint over either the bare surface or over a dry base paint coat and then streaking the tint coat, while wet, to provide a streaked pattern which gives an appearance of wood with a simulated grain pattern. For example, the U.S. Pat. No. 2,055,658 to Grison discloses a process of producing an imitation wood grain finish by brushing a pigmented substantially transparent streak coat over a dry ground coat and printing or otherwise directly applying a coat representing the pore pattern of the wood. The U.S. Pat. No. 1,902,522 to Rose discloses a process of treating a surface to simulate wood grain by splattering a dry base coat with a suitable paint and, while such splattered paint is still wet, brushing the latter with a brush or the like in generally parallel strokes to present an imitation wood grain pattern.

Although such previous processes provide an imitation wood grain appearance to a surface to which they are applied, the resulting finish is devoid of any genuine weathered or weatherbeaten antique wooden appearance.

The U.S. Pat. No. 3,692,557 to Sormani, on the other hand, discloses a process of forming an imitation antique, cracked painted wood surface by applying a base coat of specially formulated ingredients, allowing the same to dry, and then applying a different coat of specially formulated ingredients which results in a crackled appearance giving the illusion of a painted surface in which the paint has cracked due to aging. However, such finish does not present the weathered appearance of wood which has been left out in the weather over a long period of time.

SUMMARY OF THE INVENTION

A principal object of the present invention is to form a surface finish simulating a weathered or weatherbeaten antique wooden surface.

DESCRIPTION OF THE PREFERRED EMBODIMENTS

The present invention may be applied to the surface of any material, such as wood, metal, plastic, stone, cardboard or any of the well known composition materials. Preferably, the material is formed or chosen with a rough and uneven surface to represent wood which has been subjected to the ravages of the elements for many years. However, the process may equally well be applied to smooth surfaces whether absorbent or nonabsorbent.

In carrying out the process of the invention, the surface to be finished is prepared in the usual manner by removing any oil, wax or the like which might otherwise prevent paint from adhering thereto.

An opaque base coat of conventional water-base paint, commonly known as "vinyl", "latex" or the like, is applied to the surface by any known painting method as by spraying, rolling or brushing. The paint should cover substantially the entire surface to be finished and should be relatively dark in color and, preferably, of a natural wood color, such as dark brown.

While the base coat is still wet, a second coat of a generally opaque, and differently colored paint, and also of the water based type, is brushed over the first coat in generally parallel strokes to form a streaked pattern in which the second coat partly blends with the underlying base coat to present varying color gradations. The paint of the second coat is of a lighter hue than that of the base coat, such as gray. During the application of the brush strokes in applying the second coat, the brushing pressure is varied so that in those parts of the stroke in which heavy brushing pressure is applied, a greater blending occurs between the second coat and the base coat, whereas in those parts of the stroke in which light brushing pressure is applied less blending occurs so that the underlying finish will take on more of the color of the second coat. Thus, where minimum pressure is applied the color of the underlying paint finish will be substantially the pure color of the subsequently applied paint.

Although the brushing pressure may be varied in any desired manner throughout each brush stroke, it has been found that the most pleasing appearance results from applying a heavy pressure at commencement of each brush stroke and gradually reducing such pressure toward the end of the stroke.

The second coat is also applied substantially over the entire surface to be finished.

While the second coat is still wet, a third coat of a generally opaque, and differently colored paint than the paint of the second coat, and also of the water based type, is brushed over the second coat in strokes which are substantially parallel with those of the second coat to form an additional streaked pattern. The paint of such third coat is of a lighter hue than that of the second coat, preferably white. Here also, the third coat blends with the second coat depending on the amount of brushing pressure applied. Again, the brushing pressure is varied throughout each brush stroke and becomes less toward the end of the stroke. That is, where the brushing pressure is greatest, a greater amount of color blending is effected and where pressure is least, the underlying finish will take on the color of the third paint.

Preferably the third coat is not applied over the entire area but instead the brush strokes are spaced apart different distances to provide a broken pattern of colors.

Although it has been found that best results are obtained by using the aforementioned water-based paints, somewhat similar results can also be obtained by using other types of paint, such as oil based paints.

Further, in some cases where it is not necessary to present the portrayal of completely weathered wood, a somewhat less weathered effect can be produced by dispensing with the third coat. In this case, the second coat is not applied over the entire surface to be finished but the brush strokes are preferably spaced different distances apart to present an uneven color pattern.

It will be obvious to those skilled in the art that many variations may be made in the exact method disclosed without departing from the spirit and scope of this invention.

I claim:

1. The method of producing a simulated weathered antique wood finish on a surface which comprises the steps of applying an opaque colored base coat of paint substantially over all said surface, thereafter brushing a second coat of a generally opaque paint of a different color than that of said first base coat over said base coat while said base coat is still wet using generally parallel strokes parallel to said surface, said second coat of paint being compatible with said base coat and being blendable in color under brushing pressure with said wet base coat, exerting a heavier brushing pressure against said surface at the commencement of each brush stroke and gradually reducing said brushing pressure during the remainder of said brush stroke whereby to form a streaked pattern wherein said second coat blends in color with said base coat a greater amount during heavy brushing pressures and blends with said base coat a lesser amount during light brushing pressures, thereafter brushing a generally opaque third coat of paint of a different color than that of said second coat over said second coat while said second coat is still wet, using generally parallel strokes parallel to said surface which are substantially parallel to said first mentioned strokes but spaced different distances apart, said third coat of paint being compatible with said second coat and being blendable in color under brushing pressure with said wet second coat, and exerting a heavier brushing pressure against said surface at the commencement of each brush stroke of said third coat and gradually reducing said brushing pressure during the remainder of said brushing stroke whereby said third coat blends in color with said second coat a greater amount during heavy brushing pressures and blends with said second coat a lesser amount during light brushing pressures.

2. The method as defined in claim 1 wherein said paint used for said base coat and said second coat is of the water base type.

3. The method as defined in claim 1 wherein the brush strokes used to apply said second coat are substantially parallel to each other.

4. The method as defined in claim 1 wherein said base coat is brown, said second coat is grey and said third coat is white.

* * * * *